United States Patent [19]

Fustier et al.

[11] 4,115,113

[45] * Sep. 19, 1978

[54] PROCESS FOR THE PREPARATION OF MOLYBDENUM BASED ALLOYS BY SINTERING

[75] Inventors: Geraud Fustier, Bonneville; Jean-Paul Langeron, Malabry; Joseph de la Bastie; Jean Carlizza, both of Le Fayet, all of France

[73] Assignee: Cime Bocuze, Paris, France

[ * ] Notice: The portion of the term of this patent subsequent to Aug. 22, 1995, has been disclaimed.

[21] Appl. No.: 679,852

[22] Filed: Apr. 23, 1976

[30] Foreign Application Priority Data

Apr. 23, 1975 [FR] France ..... 75 13488

[51] Int. Cl.[2] ..... B22F 1/100

[52] U.S. Cl. ..... 75/206; 75/84; 75/201; 75/207; 75/211; 75/214; 75/245

[58] Field of Search ..... 75/211, 207, 84, 201, 75/245, 206, 214

[56] References Cited

U.S. PATENT DOCUMENTS

| | | | |
|---|---|---|---|
| 1,082,933 | 12/1913 | Coolidge | 75/207 X |
| 1,720,000 | 7/1929 | Ramage | 75/207 X |
| 1,822,720 | 9/1931 | Wyman | 75/211 X |
| 2,470,790 | 5/1949 | Price | 75/211 X |
| 3,676,083 | 7/1972 | Cheney et al. | 75/245 |

*Primary Examiner*—Richard E. Schafer

*Attorney, Agent, or Firm*—Dennison, Dennison, Meserole & Pollack

[57] ABSTRACT

A process for the preparation by sintering of molybdenum based alloys containing at least one reinforcing element, characterized in that at least one addition compound is introduced in the liquid state into molybdenum used in the form of at least one of the members belonging to the group consisting of the salts of molybdenum, the oxides of molybdenum and metallic molybdenum, and in that carbon is then added in sufficient quantity and the intimate member, after reduction of the matrix to the metallic state of molybdenum was used in the form of at least one molybdenum salt or at least one molybdenum oxide, is sintered at a temperature at which the said carbon at least partially reduces the addition compound.

The addition compound belongs to the group consisting of the mineral and organic compounds of titanium, zirconium, hafnium, thorium, aluminum, niobium, berylium, boron and the rare earths.

4 Claims, 1 Drawing Figure

PROCESS FOR THE PREPARATION OF MOLYBDENUM BASED ALLOYS BY SINTERING

Figure 1:
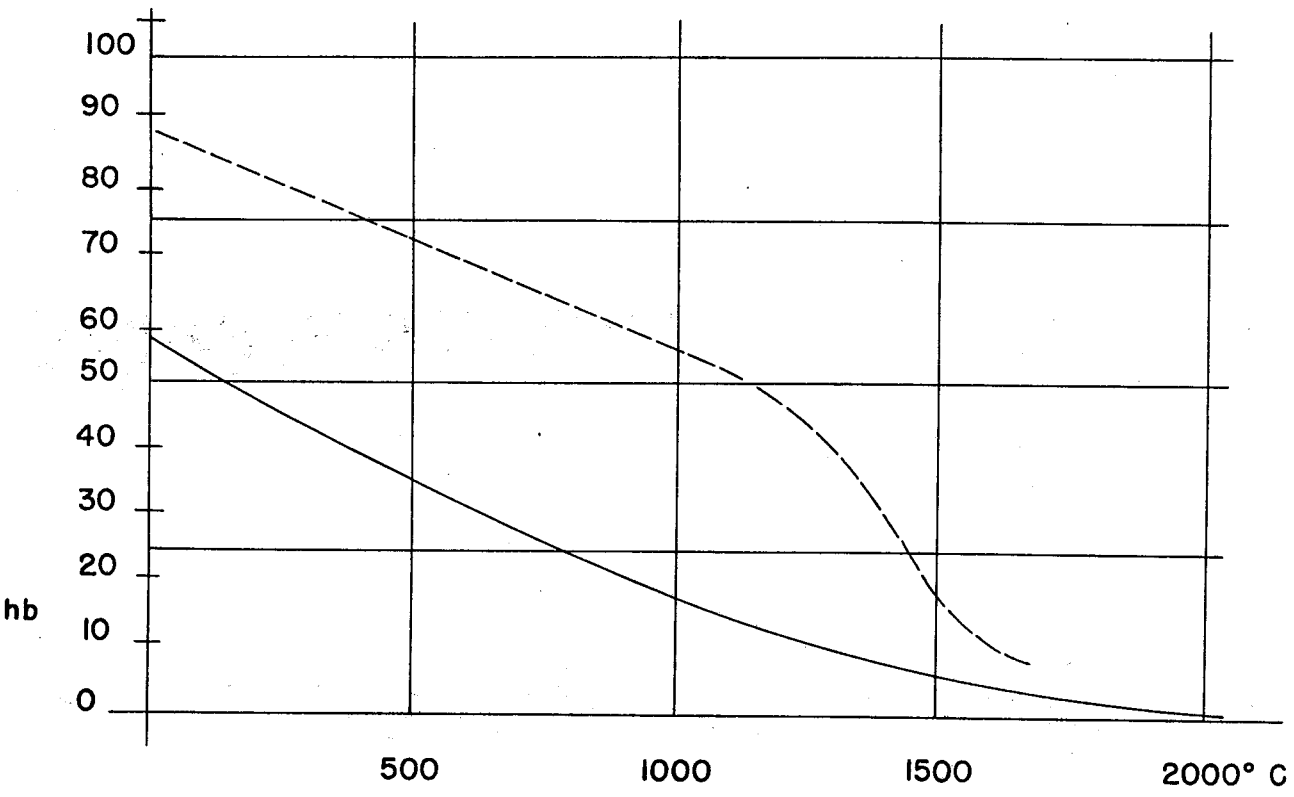

This invention relates to a new process for the preparation by sintering of molybdenum based alloys containing reinforcing elements.

The term reinforcing elements as used herein means any elements capable of being introduced intimately into molybdenum which constitutes the main element of the alloy. Thus, for example, in TZM type alloys based on molybdenum, which are well known to those skilled in the art, the reinforcing elements are titanium and zirconium present in proportions of 0.5% Ti and from 0.07% to 0.1% of Zr and carbon present in proportions of from 0.01% to 0.05%.

For a long time now those conversant in the art have attempted to devise practical methods of preparing molybdenum based alloys containing reinforcing elements such as, for example, titanium, zirconium and carbon because of the wide fields of application envisaged and found for such alloys by virtue of their particularly interesting properties. It is mainly their excellent properties of resistance to high temperatures, such as sustained hardness and rigidity, low deformation under load, high working capacity, resistance to chemical agents and resistance to molten metals in contact with them which have led the art to envisage and subsequently bring into effect their introduction into very diverse fields of application. These include, for example, the construction of certain furnaces operating under atmospheric or vacuum conditions, the use of the alloys as material for the manufacture of plugs and dies used for pressure briguetting metals, isothermal forging and extrusion, the construction of turbines, the aerospace field, etc.

Numerous processes for preparing such alloys by fusion and by sintering have already been recommended.

One of these processes consisted of intimately melting the components together. Although this method had certain advantages, as for example the possibility of controlling the balance between the carbon content and oxygen content in the melting material, it also had major disadvantages which manifested themselves in the coarse structure of the alloy and in the difficulties encountered in converting the alloy into semi-finished and finished products. Moreover, this type of process required high outlay in investments and entailed a very high cost.

It was also proposed to produce these alloys by sintering. For this purpose, a molybdenum powder was used to which was added an intimate mixture of the necessary quantities of addition compound such as, for example, zirconium oxide or hydride, titanium hydride and carbon black. The resulting mixture was then compressed under a pressure of from 1 to 5 tons per square centimeter and the briquette obtained in this way was sintered at a temperature of about 2200° C. The densities obtained after sintering were between 93% and 96% of the theoretical densities.

If this second method appeared promising, it nevertheless had major disadvantages giving rise to anomalies which the man of the art could not easily accept. These included, for example, the imperfect dispersion of the granular hydrides in molybdenum powder in the coarse of preparation of the mixture, this imperfect dispersion persisting in the finished products.

Another disadvantage was the lack of fineness of subdivision of the reinforcing elements in the original mixture, which also explained the above mentioned imperfect dispersion.

However, there were even more disturbing phenomena which could be attributed to the structure of certain reinforcing elements. Thus, for example, since hydrides of titanium and zirconium decompose very rapidly under heat treatment, the metals reacted with the occluded gases, in particular with nitrogen to give rise to nitrides which remained in the finished products. This difficulty of mastering the mechanism of decomposition of the hydrides led to inadequate control of the final carbon content.

The known manufacturing processes revealed their defects in that the qualities of the molybenum based alloys were not fully brought out or were even deleteriously affected by the poor distribution of the reinforcing elements, the formation of nitrides, etc. The processes described above were thus not able to provide alloys which were accurately reproducible from one manufacturing operation to another.

In the course of research carried out in the light of the prior art and its disadvantages and insufficiencies, the present applicants have found and put into practice a new process for the preparation by sintering of molybdenum based alloys which contain reinforcing elements and are free from the defects mentioned above.

According to the invention, the process for the preparation of molybdenum based alloys containing reinforcing elements by sintering is characterized by the fact that at least one addition compound is introduced in the liquid state into molybdenum used in the form of at least one of the members of a group consisting of the salts of molybdenum, the oxides of molybdenum and molybdenum in the state of powdered metal, and carbon is then added in sufficient quantity, and, after reduction of the member to the metallic state if molybdenum is used in the form of at least one of its oxides, the intimate mixture obtained is sintered at a temperature at which the carbon at least partially reduces the reinforcing element.

The preparatory part of the processes according to the invention consists basically of intimately mixing the main element, which is molybdenum in the form of at least one of its salt or oxides or in the metallic state, with at least one addition compound introduced in the form of a liquid.

The said addition compound is generally selected from a group consisting of mineral and organic compounds of titanium, zirconium, hafnium, thorium, niobium, berylium, boron and the rare earths. According to whether the addition compound is of organic origin or in the form of a salt of a mineral acid, it may be originally in a liquid or solid state which is readily decomposed by heat to give rise to the corresponding oxide.

If the addition compound is liquid, it is selected from among the mineral and organic compounds. Examples of these organic compounds include esters, for example tetraisopropyltitanate, and organic acid salts, for example titanium pyrrolidone carboxylate.

If the addition compound is originally in the solid state, it is dissolved in a suitable solvent, for example, water, alcohols, ketones or halogenated solvents. Thus, for example, zirconyl nitrate may be dissolved in water or alcohol, zirconyl chloride may be dissolved in water and titanium oxalate may be dissolved in water, alcohol, a ketone or even a halogenated solvent. The addition compounds may be introduced into the process at various phases of the transformation of the mixture, depending on the form in which molybdenum is put into the process, for example whether as a salt or a mixture of salts, an oxide or mixture of oxides or in the metallic state.

Thus, for example, if molybdenum is used in the form of an aqueous solution giving rise to at least one molybdenum salt, the addition compound is introduced in the original liquid state, for example as in the case of tetraisopropyl titanate, or it may be introduced as a solution in a solvent, for example zirconyl nitrate may be introduced as a solution in water, and a particularly intimate mixture of various constituents may be obtained in this way, which ultimately crystallise together and give rise to a molybdenum based powder in which the reinforcing element or elements is or are very homogeneously distributed.

If, on the other hand, molybdenum, which is the basic element, is used in the solid state, for example in the form of at least one of its salts, the reinforcing element may be introduced into the molybdenum salt before the latter is reduced first to its oxide and then to the metal. Similarly, if molybdenum is used in the form of at least one of its oxides, the addition compound may be introduced at the stage when the molybdenum is still an oxide or when it has been reduced to a metal, without the qualities of the alloy being thereby changed.

Hence if molybdenum is used in the form of at least one of its salts, the addition compound may be added to the salt itself or to the oxide after reduction of the salt or even to metallic molybdenum at the end of the reduction process.

The process is very simple to carry out. If molybdenum is used in the solid state, for example, the molybdenum powder is uniformly moistened with addition compound in the liquid state or dissolved in a solvent by known means such as atomization under pressure in a mixer. Then, if molybdenum is in the form of a salt or oxide, it is reduced to metallic molybdenum by a treatment combining the use of a reducing agent such as hydrogen with elevated temperature. The addition compound is then decomposed to the state of oxide in the form of precipitates uniformly dispersed in the oxide of basic element.

The carbon used for reducing the reinforcing element is introduced in sufficient quantities into the mixture to ensure that the reinforcing element will be at least partially reduced to the metallic state and that this fraction will completely dissolve in molybdenum in the course of the sintering operation.

The carbon may be introduced into the mixture before reduction of the molybdenum salt is carried out, but it may equally well be added to the said mixture when reduction of the molybdenum salt is already very advanced, either already to the state of molybdenum oxide or even to the state of metallic molybdenum. The carbon is intimately mixed with the other elements in the mixer according to the known various methods of introducing it.

The mixtures in the form of powder obtained by the process according to the invention are converted into briquettes by mechanical or isostatic compression, using the usual methods employed in powder metallurgy.

The sintering process in the course of which the oxide of reinforcing element is at least partially reduced to metal and this metal is dissolved in molybdenum depends on the nature of the reinforcing element. In certain cases, for example, metallic titanium is obtained at temperatures starting from 1800° C., which is lower than the temperature generally employed.

The sintered products obtained by the process according to the invention are found to have a remarkable homogeneity when examined under microscope.

EXAMPLE 1

A molybdenum alloy containing 0.5% of titanium and 0.08% of zirconium was prepared by the process according to the invention.

80 kg of ammonium decamolybdate were introduced into a mixer of known type which was already in operation. A solution of 115 g of zirconyl nitrate in 1500 cc of demineralized water was then atomized, followed by atomization of 1500 cc of isopropyl titanate.

After atomization of the two liquids, the mixture was crushed for several seconds. The powder was then ready to be reduced by conventional means without first being dried.

The mixer was normally operated for about 15 minutes.

After reduction by hydrogen, part of the powder was returned to the mixer into which were introduced 2.5% by weight of carbon, based on the weight of the reduced molybdenum powder containing the reinforcing elements. and the mixture was stirred for 10 minutes to form a first mother mixture. This mixture was added under the same conditions to the remainder of the reduced powder in a quantity such that it amounted to 10% of the total quantity of mixture, thereby reducing the final carbon content to 0.25%.

Alloys were then produced by compression of the mixture under a pressure of 1000 bars, and the briquettes obtained were sintered at a temperature of 1800° C. in a continuous furnace for 10 hours to ensure complete reduction of titanium oxide and solution of the titanium in molybdenum.

The quality of the alloy after sintering was remarkable and examination under the microscope showed that the titanium had been completely dissolved while part of the zirconium oxide appeared as a very finely dispersed phase.

EXAMPLE 2

A molybdenum alloy containing zirconium and titanium was prepared by the process according to the invention.

100 kg of metallic molybdenum powder were introduced into the mixer. 3232 cc of isopropyl titanate were then atomized, followed by atomization of a solution of 248 g of zirconyl nitrate in 3000 cc of ethanol.

The moistened powder was treated in a stream of hydrogen at 500° C. to convert the addition compounds into $TiO_2$ and $ZrO_2$. This powder was returned to the mixer and 250 g of carbon were then added and mixed. Mixture was pressed were moulded at 1000 bars and then sintered at 1800° C. The microscopic results were the same as in Example 1.

The alloys obtained by the process according to the invention show the same exceptionally high rupture strength under heat which are greatly superior to those of pure molybdenum obtained by powder metallurgy.

Thus a molybdenum based alloy containing 0.5% of titanium and 0.08% of zirconium has a resistance to breakage in *h* bar up to 1500° C. which is at least twice the strength of pure molybdenum at this temperature, as can be seen from FIG. 1 where the curve in broken lines represents the strength to strength of the aforesaid alloy up to 1700° C. while the solid line curve represents the rupture strength of molybdenum up to 2000° C.

We claim:

1. A process for the preparation of molybdenum based alloys containing titanium and zirconium as reinforcing elements, comprising (a) introducing isopropyl titanate and zirconyl nitrate, as addition compounds, in solution form, at least one of which is dissolved in an organic solvent, into molybdenum used in the form of metallic molybdenum or ammonium decamolybdate, (b) reducing the mixture of isopropyl titanate, zirconyl nitrate and metallic molybdenum or ammonium decamolybdate with hydrogen, whereby the ammonium decamolybdate is reduced to the metallic state of molybdenum, and the isopropyl titanate and zirconyl nitrate are converted to $TiO_2$ and $ZrO_2$, respectively, (c) adding and mixing carbon in sufficient quantity and at a temperature at which said carbon partially reduces the addition compound, (d) compressing the so-reduced mixture into briquettes, under a pressure of about 1000 bars, and (e) sintering, whereby the titanium is dissolved and the zirconium appears as a finely dispersed phase.

2. A process according to claim 1 wherein the prepared alloy contains 0.5% of titanium, 0.08% zirconium, and 0.25% carbon.

3. A process according to claim 1 wherein the molybdenum is used in the form of metallic molybdenum.

4. A process according to claim 1 wherein the molybdenum is used in the form of ammonium decamolybdate.

* * * * *